US008424850B2

(12) United States Patent
Bennette

(10) Patent No.: US 8,424,850 B2
(45) Date of Patent: Apr. 23, 2013

(54) BALUSTER MOUNTING SYSTEM

(75) Inventor: Richard G. Bennette, Boerne, TX (US)

(73) Assignee: Creative Industries, LLC, Boerne, TX (US)

( * ) Notice: Subject to any disclaimer, the term of this patent is extended or adjusted under 35 U.S.C. 154(b) by 172 days.

(21) Appl. No.: 12/762,727

(22) Filed: Apr. 19, 2010

(65) Prior Publication Data

US 2011/0253964 A1 Oct. 20, 2011

Related U.S. Application Data

(63) Continuation-in-part of application No. 11/809,744, filed on Jun. 1, 2007, now Pat. No. 7,722,207.

(51) Int. Cl.
*E04H 17/00* (2006.01)

(52) U.S. Cl.
USPC ..... 256/65.05; 256/68; 256/10; 362/152; 362/431

(58) Field of Classification Search ..... 256/1, 10, 256/22, 68, 65.04, 65.05; 403/353; 439/389; 362/145, 146, 152, 431
See application file for complete search history.

(56) References Cited

U.S. PATENT DOCUMENTS

| | | | | |
|---|---|---|---|---|
| 1,797,883 | A * | 3/1931 | Strubel | 52/693 |
| 4,958,954 | A * | 9/1990 | Schmanski et al. | 404/10 |
| 5,261,201 | A | 11/1993 | Smith | |
| 5,321,592 | A * | 6/1994 | Marinacci | 362/640 |
| 5,484,137 | A * | 1/1996 | Smith | 256/50 |
| 5,657,968 | A | 8/1997 | Marsden | |
| 5,829,865 | A * | 11/1998 | Ahroni | 362/657 |
| 6,481,697 | B1 | 11/2002 | Brown | |
| 6,494,438 | B1 * | 12/2002 | Noirot et al. | 256/59 |
| 6,505,950 | B1 * | 1/2003 | Natoli et al. | 362/146 |
| 6,543,751 | B1 * | 4/2003 | Spruill | 256/65.04 |
| 6,854,196 | B2 | 2/2005 | Burrell et al. | |
| 6,905,110 | B2 | 6/2005 | Brown | |
| 7,048,259 | B2 * | 5/2006 | Quaintance et al. | 256/65.06 |
| 7,052,170 | B2 * | 5/2006 | Striebel | 362/640 |
| 7,104,525 | B2 * | 9/2006 | Ricci | 256/65.14 |
| 7,246,935 | B2 * | 7/2007 | Benghozi et al. | 362/648 |
| 7,434,971 | B1 * | 10/2008 | Wang | 362/496 |
| 7,441,750 | B1 * | 10/2008 | Harder | 256/22 |
| 7,455,282 | B2 | 11/2008 | Platt | |
| 7,473,016 | B2 * | 1/2009 | Flaherty et al. | 362/431 |
| 7,722,207 | B2 * | 5/2010 | Bennette | 362/146 |
| 7,762,533 | B2 * | 7/2010 | DeRogatis et al. | 256/67 |
| 2008/0298049 | A1 * | 12/2008 | Bennette | 362/145 |

* cited by examiner

*Primary Examiner* — Daniel P. Stodola
*Assistant Examiner* — Jonathan Masinick
(74) *Attorney, Agent, or Firm* — Kelly & Kelley, LLP

(57) ABSTRACT

A baluster mounting system includes removably locking a baluster between oppositely disposed upper and lower surfaces. A first rail connector is fixed relative to either an upper or lower surface. A second rail connector is fixed relative to either the upper or lower surface which is opposite the first rail connector. A baluster is removably locked between the first and second rail connectors. The first rail connector is configured to slidably receive an end of the baluster and the second rail connector is configured to laterally receive an opposite end of the baluster. A locking sleeve is slidable along a portion of the baluster and configured for locking engagement with the second rail connector.

18 Claims, 6 Drawing Sheets

BALUSTER MOUNTING SYSTEM

BACKGROUND OF THE INVENTION

The present invention is generally directed to balusters. More particularly, the present invention is directed to a baluster mounting system that facilitates the easy installation, removal and replacement of balusters.

Balusters are any of a number of closely spaced supports for a railing or other structures such as furniture, balconies, decks, fences, staircases, windows and arches. Balusters have typically been a shaft fabricated from stone, metal or wood standing on a unifying footing and supporting a handrail (also known as a banister) of a staircase or railing. Typically a baluster is fashioned with decorative or ornamental features as they are routinely used as artistic pieces rather than just being utilitarian structures. A multitude of balusters are referred to in the trade as a balustrade.

Crafting and assembling a balustrade for a railing or the like is a labor intensive job. A common construction process is to position each baluster along the path of a future railing by securing the baluster at its base. At this time the exact spacing of the baluster is needed and also the balusters themselves must be ready for installation. Typically a newel post or other structural support encompasses the two ends of the balustrade, as the balustrade itself is typically not a structural member fully supporting the railing or overhead support. After each baluster is properly positioned and secured, a railing or upper support is then attached on top of the balusters. A common practice is that each baluster penetrate a certain distance into the railing or upper support. Also, a common practice is to use a female receptacle which captures the top and bottom ends of the balusters between top and bottom support rails. For example, a railing would need to have pre-fabricated receptacles for each corresponding baluster to reside within. There is little room for error during the construction process. One cannot easily change the spacing between balusters as it would require the disassembly of the whole railing and balustrade assembly. Furthermore, one cannot easily change or replace the balusters themselves as they are permanently constructed as part of the railing.

Balusters of the past have typically been heavy and substantial in size. For instance, balusters have been traditionally formed with wood and stone that was shaped on a lathe. Some balusters were made of iron rods bent and formed into decorative shapes. While beautiful and intricate, these fabrication methods of the past were also very labor intensive. Newer technologies involve using molds and castings for balusters made of concrete, plaster, and plastics. Furthermore, new materials can be used to form balusters, such as extruded metallic tubes and molded plastics. While the manufacturing time of a prefabricated baluster has decreased, there is still a desire by the consumer to be able to customize their own balustrade assembly.

In efforts to satisfy the need for individual customization, decorative lighting has been used in connection with balusters. One simple way of lighting balusters has been to illuminate them with a series of external lights or a single spot light. However, a more aesthetically pleasing design includes decorative lighting integrated into the hollow inside of a baluster such that it radiates outwardly at the flip of a switch through transparent or translucent portions of the baluster. For instance, patent publication number 2008/0298049 A1 teaches a Baluster Lighting Assembly And Method, which is incorporated herein by reference. However, properly spacing each baluster still remains a difficult job to get right the first time. There is no current method for installing more or less balusters once the railing is assembled. Furthermore, after some time a different baluster design or internal lighting color may be desired by the consumer.

Accordingly, there is a need for a baluster mounting system that facilitates the easy installation, removal, adjustment and replacement of individual balusters without the need to remove or disassemble the railing or overhead support. Furthermore, there is a need for a baluster mounting system, if desired but not necessary, to allow each baluster and an internal light emitting diode to be electrically connected to a power cable. Whether a light emitting diode is used or not, the balusters can be easily installed, removed, adjusted, or replaced. The present invention fulfills these needs and provides other related advantages.

SUMMARY OF THE INVENTION

The baluster mounting system includes removably locking a baluster between oppositely disposed upper and lower surfaces. A first rail connector is fixed relative to either an upper or lower surface. A second rail connector is fixed relative to either the upper or lower surface which is opposite the first rail connector. A baluster is removably locked between the first and second rail connectors. The first rail connector is configured to slidably receive an end of the baluster and the second rail connector is configured to laterally receive an opposite end of the baluster. A locking sleeve is slidable along a portion of the baluster and configured for locking engagement with the second rail connector.

The locking sleeve is rotatable about the second rail connector to prevent axial movement of the locking sleeve relative to the baluster. The second rail connector includes a C-shaped wall having an upper edge defining an upper opening and a lower edge connected to a base of the second rail connector. An aperture is disposed within the base of the second rail connector and a screw is disposed through the aperture for attaching the second rail connecter to its corresponding surface. The base of the second rail connector can be perpendicular to the baluster or angled to match an angled surface such that the baluster remains upright and vertical. More specifically, the locking sleeve may include a protrusion that is rotatably locked into a recess within the base of the second rail connector to prevent axial movement of the locking sleeve relative to the baluster.

The first rail connector includes a top rail connector and a pierce connector. The pierce connector is disposed between and slidably joined to the top rail connector and baluster. The top rail connector includes a threaded portion and a corresponding threaded sleeve is slidable and rotatable about the baluster.

The top rail connector and pierce connector cooperatively form an electrical cord channel. An aperture is disposed within a base of the top rail connector and a screw is disposed through the aperture for attaching the top rail connector to its corresponding surface. The base of the top rail connector can be perpendicular to the baluster or angled to match an angled surface such that the baluster remains upright. An insulative cover can be disposed between the screw and the electrical cord channel, but is not required.

The baluster is at least partially hollow and includes a light emitting diode attached relative to the pierce connector within the baluster. An electrical cord is captured within the electrical cord channel and in electrical communication with the light emitting diode through the pierce connector. The baluster can take a multitude of shapes and designs and can include portions that are either translucent or transparent.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
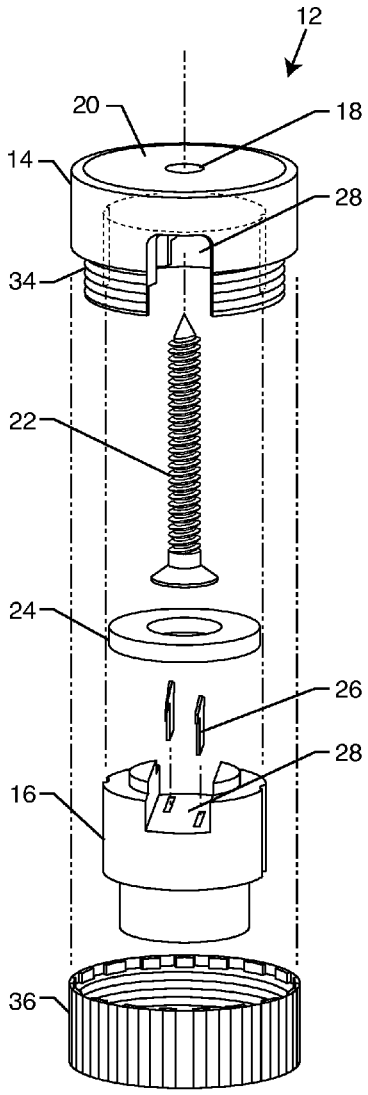
FIG. 1 is an exploded perspective view of an exemplary embodiment of a rail connector assembly embodying the present invention.

As shown in the drawings for purposes of illustration, the present invention for a baluster mounting system is referred to generally by the reference number 10. FIG. 1 is an exploded perspective view of an exemplary embodiment of a first rail connector 12 embodying the present invention. The first rail connector 12 includes a top rail connector 14 that is configured to slidably receive a pierce connector 16. In this embodiment, the pierce connector 16 is slid within the top rail connector 14, however other designs are possible where the top rail connector 14 is slid within the pierce connector 16. An aperture 18 is disposed within the base 20 of the top rail connector 14. A screw 22 is disposed through the aperture 18 for attaching the top rail connector 14 to a corresponding surface.

Figure 3:
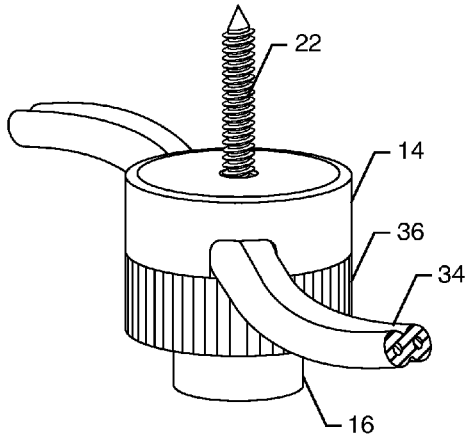
FIG. 3 is the perspective view of the structure of FIG. 2 now with an electrical cord.
Figure 2:
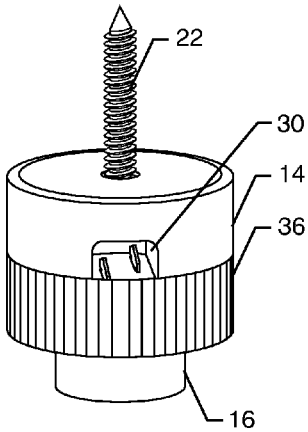
FIG. 2 is a perspective view of the structure of FIG. 1 now assembled.

The top rail connector 14 is also configured to receive an insulative cover 24. The insulative cover 24 functions as an insulator between the screw 22 and the pierce connector 16. Installed in the pierce connector 16 are piercing prongs 26 that are used to pierce into an electrical power supply. The top rail connector 14 and the pierce connector 16 both have corresponding channels 28 that when combined cooperatively form an electrical cord channel 30 for the capture of an electrical cord 32 as shown in FIGS. 2 and 3. FIG. 2 is a perspective view of the structure of FIG. 1 now assembled. The corresponding channels 28 have now formed the electrical cord channel 30. FIG. 3 is a perspective view of the structure of FIG. 2 now with the electrical cord 32 being captured within the electrical cord channel 30. A typical electrical cord 32 has a conductive wire core encapsulated by an insulative cladding. The piercing prongs 26 penetrate the insulative cladding to then be in electrical communication with the conductive wire core. As will be later discussed, this is necessary to provide power for various internally housed baluster lighting configurations.

Referring back to FIG. 1, the top rail connector 14 has a threaded portion 34 that corresponds to attach to a threaded sleeve 36. The threaded sleeve 36 can be fastened onto the threaded portion 34 of the top rail connector 14 as shown in FIGS. 1 and 2. As the threaded sleeve 36 is screwed onto the threaded portion 34, it pushes against the pierce connector 16 and forces the piercing prongs 26 to penetrate the electrical cord 32. This design facilitates the ease of installation of piercing the electrical cord 32.

Figure 4:
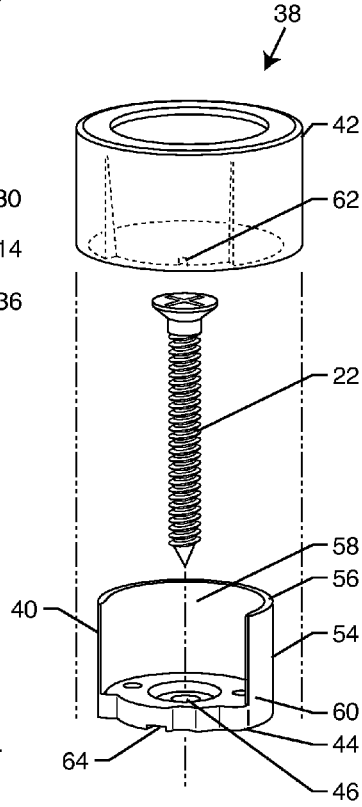
FIG. 4 is an exploded perspective view of another exemplary embodiment of a rail connector assembly embodying the present invention.

FIG. 4 is an exploded perspective view of an exemplary embodiment of a second rail connector assembly 38 embodying the present invention. The second rail connector assembly 38 includes a second rail connector 40 and a locking sleeve 42. The base 44 of the second rail connector 40 has an aperture 46 disposed there through. A screw 22 is disposed through the aperture 46 for attaching the second rail connector 40 to a corresponding surface.

Many of the component parts described above can be manufactured from various materials known and used today. For instance, injection molding of plastic is a common process suitable for manufacturing the first rail connector 12, the pierce connector 16, the insulative cover 24, the threaded sleeve 36, the second rail connector 40, and the locking sleeve 42. This specification is not intended to limit the manufacturing methods to just the precise forms described herein. The insulative cover 24 should be made from a non-conductive material. It is also desirable to manufacture the top rail connector 14 and the pierce connector 16 also from a non-conductive material to limit any chance of inadvertent electrical shock or leakage.

Figure 5:
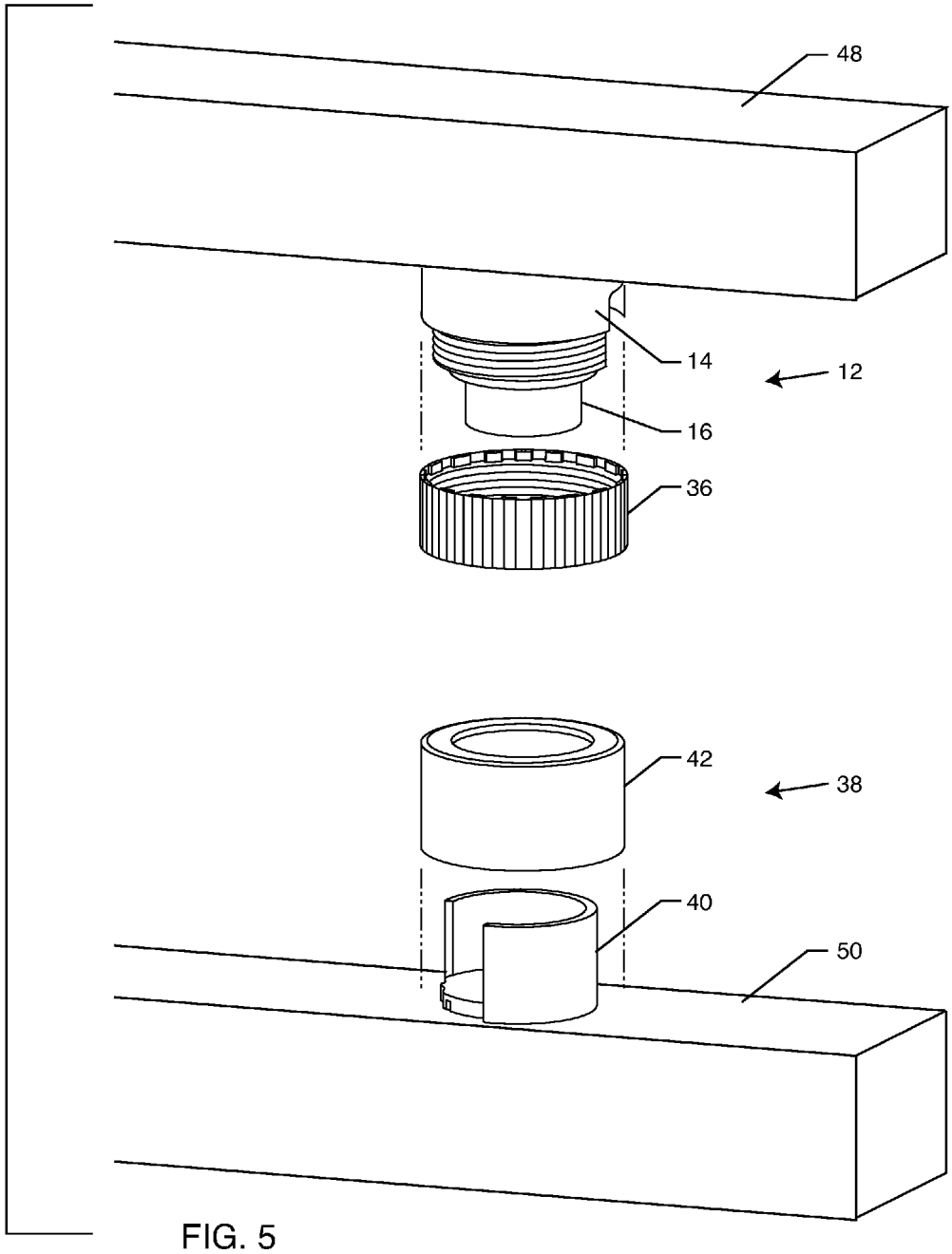
FIG. 5 is a perspective view of the rail connectors of FIGS. 1 and 4 now mounted to upper and lower surfaces.

FIG. 5 is a perspective view of the rail connectors of FIGS. 1 and 2 now mounted to corresponding surfaces. The first rail connector 12 is mounted to an upper surface 48 and the second rail connector assembly 38 is mounted to a lower surface 50. It is to be understood that the positions of the rail connectors are interchangeable, in that the top rail connector 14 can be mounted on the lower surface 50 and the second rail connector 40 can be mounted on the upper surface 48.

Figure 6:
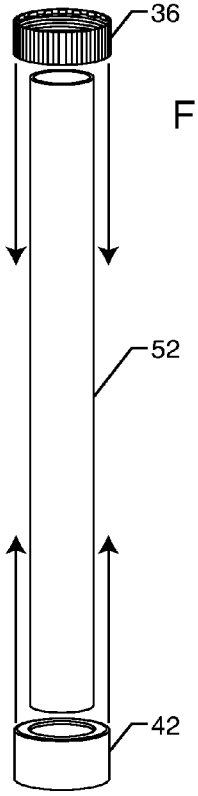
FIG. 6 is a perspective view of a baluster with locking sleeve and threaded collar.

FIG. 6 is a perspective view of a baluster 52 with locking sleeve 42 and threaded collar 36 slidable thereon. The baluster 52 can take many shapes and forms, and this specification is not intended to limit it to the precise form described herein. As shown in FIG. 4, the baluster 52 is cylindrically shaped and hollow. The locking sleeve 42 is slidable along the baluster 52 as shown from the bottom, and the threaded collar 36 is also slidable along the baluster 52 as shown from the top.

Figure 7:
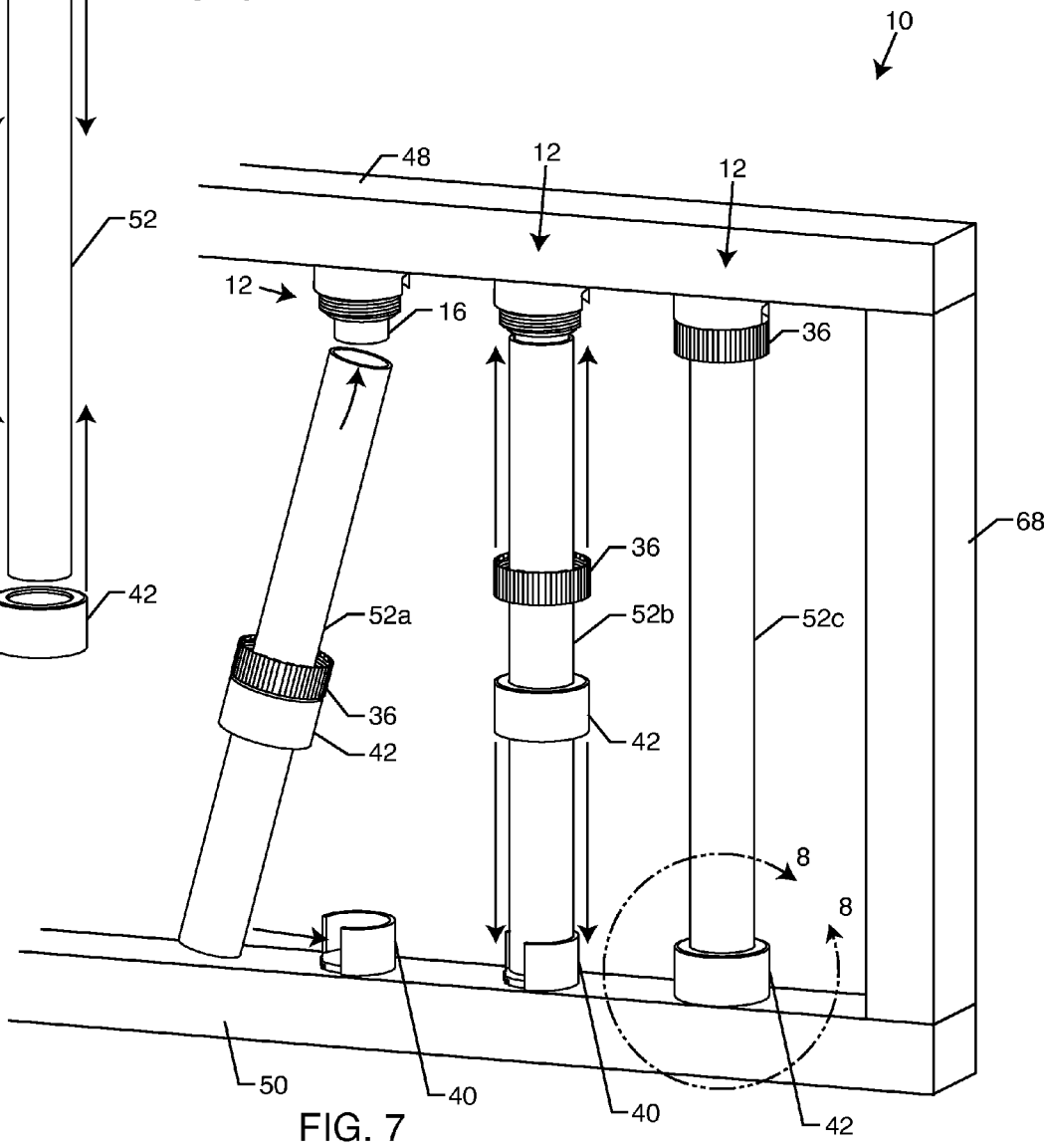
FIG. 7 is a perspective view similar to FIG. 5 now showing a baluster mounted within the rail connectors.
Figure 10:
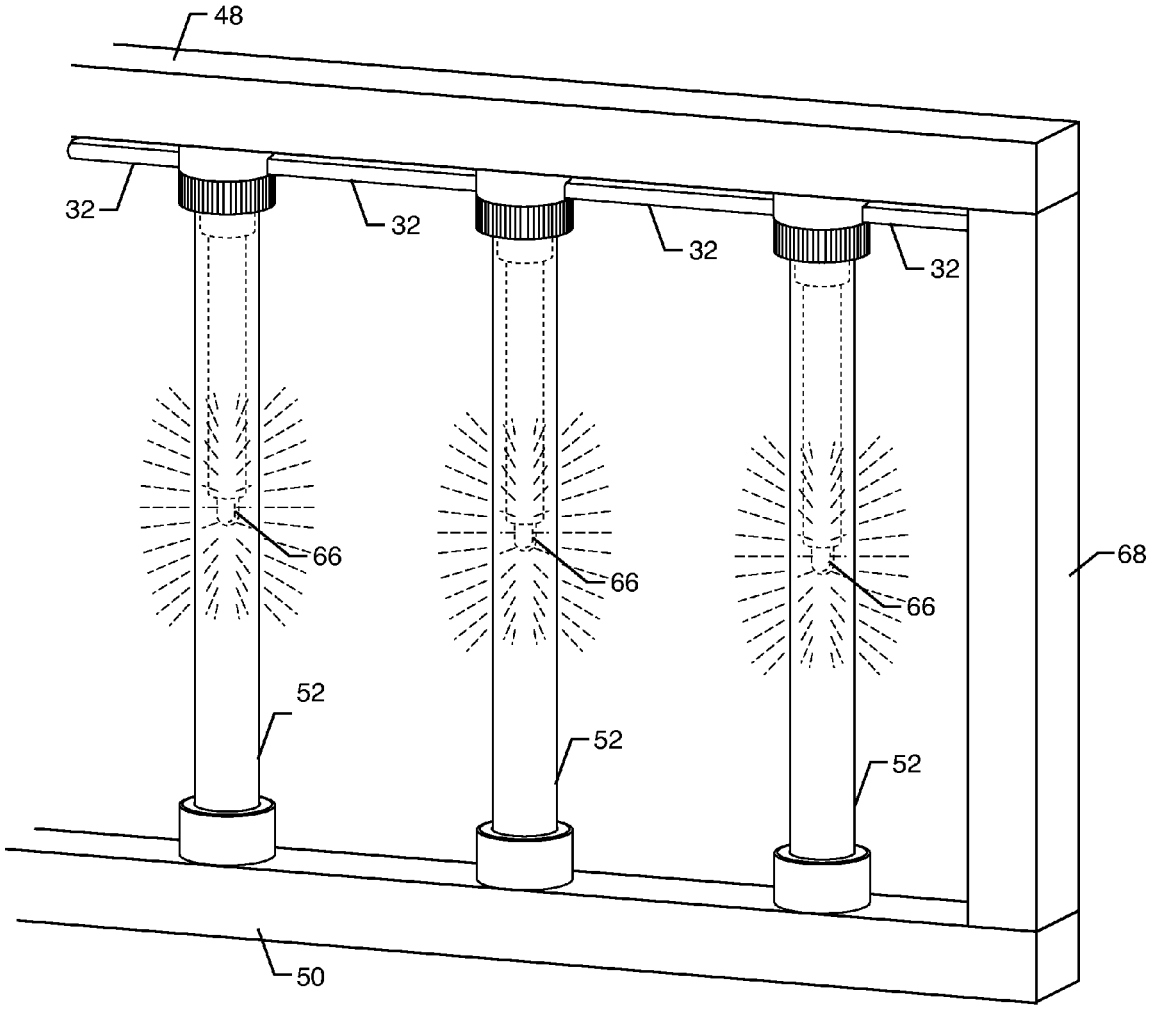
FIG. 10 is a perspective view of mounted balusters with light emitting diodes.

FIG. 7 is a perspective view similar to FIG. 3 now showing the baluster 52 of FIG. 4 mounted within the rail connectors. The upper and lower surfaces 48, 50 are disposed a fixed, predetermined distance from each other consistent with the length of upright member 68. FIG. 10 depicts a similar configuration with upright member 68 defining a fixed, predetermined distance between upper and lower surfaces 48, 50. Starting with left most baluster 52*a*, the locking sleeve 42 and the threaded collar 36 are slid to the center of the baluster 52*a*. Next, the baluster 52*a* is first slidably engaged with the first rail connector 12. In this embodiment, the hollow baluster 52 slides over the pierce connector 16 as shown with the middle baluster 52*b*. Now the baluster 52*b* can be slid laterally to engage with the second rail connector 40. Referring back to FIG. 2, the second rail connector 40 has a C-shaped wall 54 having an upper end 56 defining an upper opening 58 and a lower edge 60 connected to the base 44. As shown with the baluster 52*b* of FIG. 7, the C-shaped wall 54 is configured to laterally receive the baluster 52*b*. Now, as shown with the right most baluster 52*c*, the locking sleeve 42 can then slide down over the second rail connector 40 securing the baluster 52*c* within the rail connectors. The baluster 52*c* is prevented from now laterally sliding out of the C-shaped wall 54 due to the interference between the locking sleeve 42 and second rail connector 40. Also, the threaded sleeve 36 can now be threaded onto the threaded portion 34 of the top rail connector 14.

Figure 8:
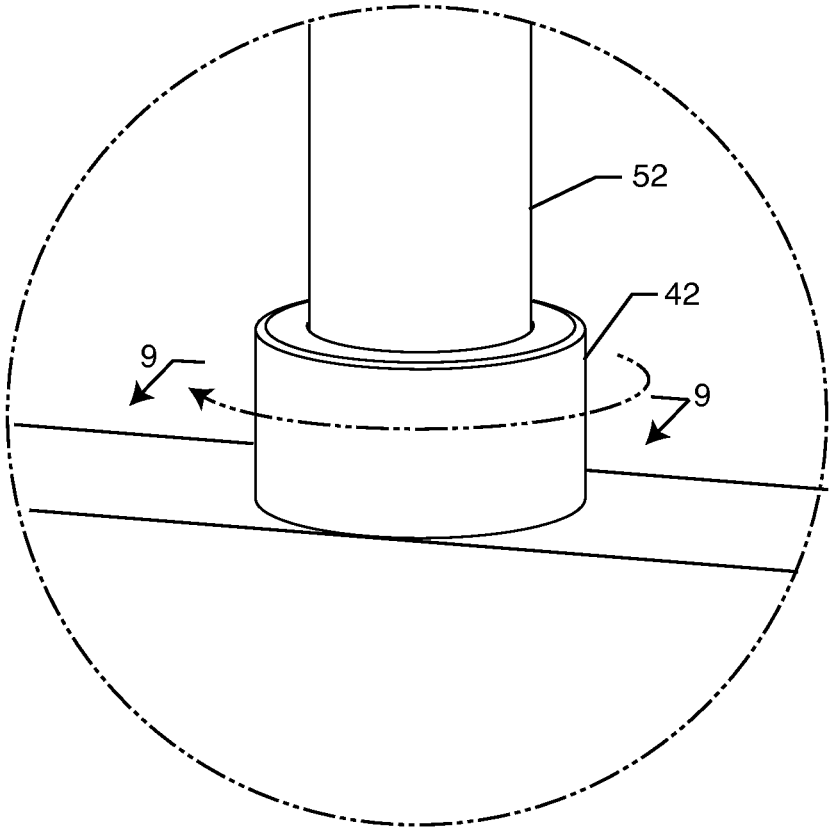
FIG. 8 is an enlarged perspective view of the structure of FIG. 7 taken along line 8-8.

FIG. 8 is an enlarged perspective view of the structure of FIG. 7 taken along line 8-8. The locking sleeve 42 has been slid over the second rail connector 40 and prevents the baluster 52 from laterally sliding out of the C-shaped wall 54. The locking sleeve 42 is then further rotated to prevent axial movement of the locking sleeve 42 relative to the baluster 52 by locking into engagement with the second rail connector 40. This is better understood referring to FIG. 4 and also FIGS. 9*a* and 9*b*.

Figure 9A:
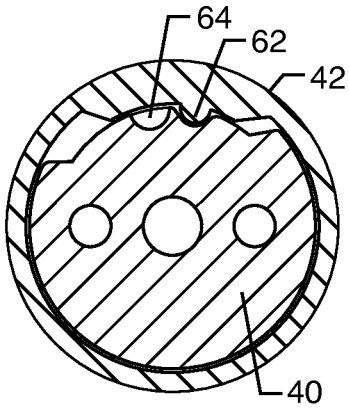
FIG. 9*a* is a sectional view of the structure of FIG. 8 taken along line 9-9.
Figure 9B:
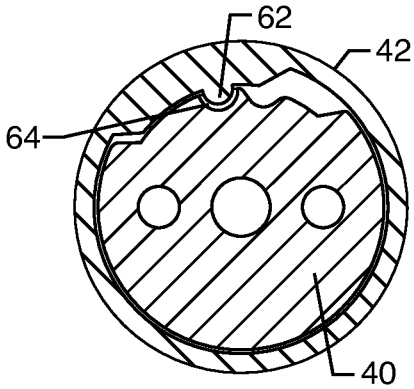
FIG. 9*b* is another sectional view of the structure of FIG. 8 taken along line 9-9.

FIG. 9*a* is a sectional view of the structure of FIG. 8 taken along line 9-9 before the locking sleeve 42 is locked with the second rail connector 40. A small protrusion 62 is disposed on the inner wall of the locking sleeve 42. This protrusion 62 is correspondingly shaped to be received by a small recess 64 disposed within the second rail connector 40. FIG. 9*b* is another sectional view of the structure of FIG. 8 taken along line 9-9 where now the locking sleeve 42 has been rotated such that the protrusion 62 is locked within the recess 64. The locking sleeve 42 can no longer slide relative to the baluster 52.

FIG. 10 is a perspective view of mounted balusters 52 with light emitting diodes 66. Light emitting diodes 66 are electrically connected to the piercing prongs 26, which are electrically connected to the electrical cord 32. The light emitting diodes 66 are now disposed within the hollow baluster 52. When power is supplied to the light emitting diodes 66 light radiates within the baluster 52. In various embodiments, the baluster may be either partially translucent or partially transparent. Light can then radiate out the baluster 52 and create various lighting schemes and effects. As can be seen by one skilled in the art, there are a limitless amount of possible designs of light emitting balusters 52, and this disclosure is not intended to limit it to just the precise form described herein. It is now to be understood that the balusters 52 can be easily mounted and later removed if need be. Different light emitting diodes 62 can be used or replaced to emit different colors and intensities. Also, different balusters of varying translucency and transparency may be used to create different lighting schemes and effects.

It is also to be understood by one skilled in the art that the baluster mounting system 10 doesn't need to incorporate any feature directed towards incorporating the light emitting diodes 66. The baluster mounting system 10 can be used to mount and replace a multitude of balusters 52 that are without the pierce connector 16, the piercing prongs 26, the electrical cord channel 30, the insulative cover 24, the electrical cord 32, and the light emitting diodes 66. For instance, the pierce connector 16 can be incorporated with the top rail connector 14 into a single part thereby comprising the first rail connector 12.

Figure 11:
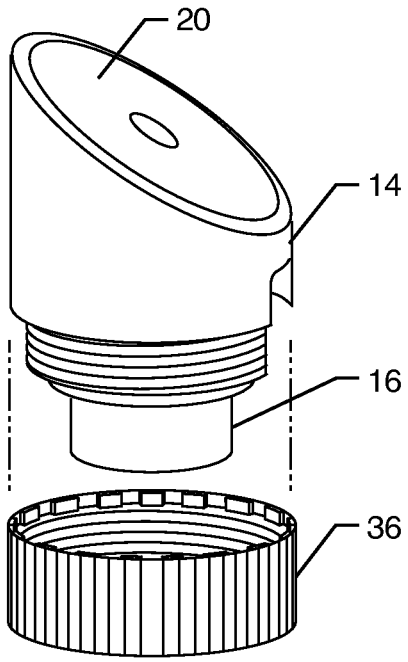
FIG. 11 is a perspective view of another embodiment of a rail connector similar to FIG. 1 now with an angled base.
Figure 12:
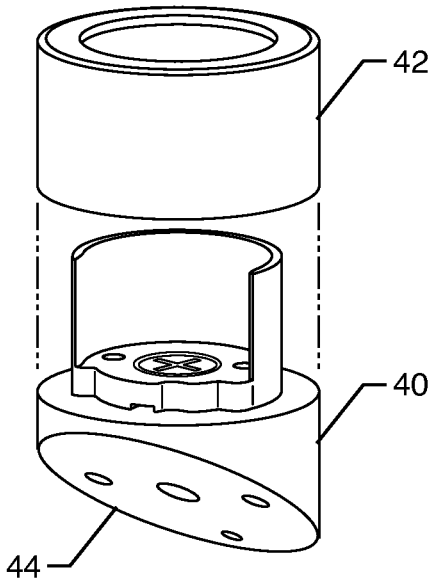
FIG. 12 is a perspective view of another embodiment of a rail connector similar to FIG. 4 now with an angled base.

FIGS. 11 and 12 are perspective views of other embodiments of rail connectors similar to FIGS. 1 and 4 now with angled bases. The top rail connector 14 has an angled base 20 and the second rail connector 40 has an angled base 44. The angled base is used to mount to various upper and lower surfaces 48 and 50 that may be angled with respect to the horizon. These angled upper and lower surfaces 48 and 50 may be part of steps or other surfaces where it is desired that the balusters 52 remain vertical to the horizon even though the surface it is mounted to is angled. As can be seen by one skilled in the art, the specific angle can vary between zero degrees to less than ninety degrees. However, the angle will rarely be significantly above 45 degrees for practical purposes. This disclosure is not intended to limit the angle at any one specific angle.

Although several embodiments have been described in detail for purposes of illustration, various modifications may be made to each without departing from the scope and spirit of the invention. Accordingly, the invention is not to be limited, except as by the appended claims.

What is claimed is:

1. A mounting system for removably locking a baluster in a balustrade, the balustrade having upper and lower surfaces that are oppositely disposed a fixed distance apart, wherein corresponding ends of the balustrade are encompassed by structural supports defining the fixed distance, the mounting system comprising:

a first baluster connector fixed to either the upper or lower surface;

a second baluster connector fixed to either the upper or lower surface which is opposite the first baluster connector;

a baluster removably locked between said first and second baluster connectors, wherein the first baluster connector is configured to slidably receive, in a first direction, an end of the baluster and the second baluster connector is configured to laterally receive, in a second direction generally perpendicular to the first direction, an opposite end of the baluster, and wherein both connectors are configured such that the baluster is removable without removing the structural supports encompassing the corresponding ends of the balustrade and without changing the fixed distance between the upper and lower surfaces; and a locking sleeve slidable along a portion of the baluster and configured for locking engagement with the second baluster connector; and wherein the locking sleeve is rotatable about the second baluster connector to prevent axial movement of the locking sleeve relative to the baluster.

2. The system of claim 1, wherein the second rail baluster connector includes a C-shaped wall having an upper edge defining an upper opening and a lower edge connected to a base of the second baluster connector.

3. The system of claim 2, including an aperture disposed within the base of the second baluster rail connector and a screw disposed through the aperture for attaching the second baluster rail connecter to its corresponding surface.

4. The system of claim 2, wherein the base of the second baluster rail connector is angled.

5. The system of claim 1, wherein the first baluster connector comprises a top rail connector and a pierce connector, wherein the pierce connector is disposed between and slidably joined to the top rail connector and baluster.

6. The system of claim 5, wherein the top rail connector comprises a threaded portion and including a corresponding threaded sleeve slidable and rotatable about the baluster.

7. The system of claim 5, wherein the top rail connector and pierce connector cooperatively form an electrical cord channel.

8. The system of claim 7, including an aperture disposed within a base of the top rail connector and a screw disposed through the aperture for attaching the top rail connector to its corresponding surface.

9. The system of claim 8, wherein the base of the top rail connector is angled.

10. The system of claim 8, including an insulative cover disposed between the screw and the electrical cord channel.

11. The system of claim 7, wherein the baluster is at least partially hollow and including a light emitting diode attached to the pierce connector within the baluster.

12. The system of claim 11, further including an electrical cord captured within the electrical cord channel and in electrical communication with the light emitting diode through the pierce connector.

13. The system of claim 12, wherein the baluster is at least partially translucent.

14. The system of claim 12, wherein the baluster is at least partially transparent.

15. The system of claim 1, wherein the second baluster connector includes a recess and the locking sleeve includes a protrusion, wherein the locking sleeve and protrusion are rotatable about the second baluster connector to rotatably engage the protrusion within the recess to prevent axial movement of the locking sleeve relative to the baluster.

16. A mounting system for removably locking a baluster in a balustrade, the balustrade having upper and lower surfaces that are oppositely disposed a fixed distance apart, wherein corresponding ends of the balustrade are encompassed by structural supports defining the fixed distance, the mounting system comprising:

a first baluster connector fixed to either the upper or lower surface;

a second baluster connector fixed to either the upper or lower surface which is opposite the first baluster connector wherein the second baluster connector includes a C-shaped wall having an upper edge defining an upper opening and a lower edge connected to a base of the second baluster connector;

a baluster removably locked between said first and second baluster connectors, wherein the first baluster connector is configured to slidably receive, in a first direction, an end of the baluster and the second baluster connector is configured to laterally receive, in a second direction generally perpendicular to the first direction, an opposite end of the baluster, and wherein both connectors are configured so as to permit the baluster to be removed without removing the structural supports encompassing the corresponding ends of the balustrade and without changing the fixed distance between the upper and lower surfaces; and a locking sleeve slidable along a portion of the baluster, rotatable about the second baluster connector and configured for locking engagement with the second baluster connector to prevent axial movement of the locking sleeve relative to the baluster.

17. The system of claim 16, wherein the first baluster connector comprises a top rail connector and a pierce connector, wherein the pierce connector is disposed between and slidably joined to the top rail connector and baluster, and wherein the top rail connector and pierce connector cooperatively form an electrical cord channel.

18. A mounting system for removably locking a baluster in a balustrade, the balustrade having upper and lower surfaces that are oppositely disposed a fixed distance apart, wherein corresponding ends of the balustrade are encompassed by structural supports defining the fixed distance, the mounting system comprising:

a first baluster connector fixed to either the upper or lower surface comprising a top rail connector slidably joined with a pierce connector where the top rail connector and pierce connector cooperatively form an electrical cord channel;

a second baluster connector fixed to either the upper or lower surface which is opposite the first baluster connector;

a baluster removably locked between said first and second baluster connectors, wherein the first baluster connector is configured to slidably receive in a first direction an end of the baluster and the second baluster connector is configured to laterally receive, in a second direction generally perpendicular to the first direction, an opposite end of the baluster, and wherein both connectors are configured such that the baluster is removable without removing the structural supports encompassing the corresponding ends of the balustrade and without changing the fixed distance between the upper and lower surfaces; and a locking sleeve slidable along a portion of the baluster and configured for locking engagement with the second baluster connector; and wherein the locking sleeve is rotatable about the second baluster connector to prevent axial movement of the locking sleeve relative to the baluster and wherein the second baluster connector includes a C-shaped wall having an upper edge defining an upper opening and a lower edge connected to a base of the second baluster connector.

* * * * *